US007607936B2

(12) United States Patent
Mizoguchi et al.

(10) Patent No.: US 7,607,936 B2
(45) Date of Patent: Oct. 27, 2009

(54) POWER SUPPLY METHOD TO MEMORY CARD AND PRINTING APPARATUS

(76) Inventors: Masahiko Mizoguchi, c/o Seiko Epson Corporation, 3-5, Owa 3-chome, Suwa-shi, Nagano-ken 392-8502 (JP); Mitsuo Sakurai, c/o Seiko Epson Corporation, 3-5, Owa 3-chome, Suwa-shi, Nagano-ken 392-8502 (JP); Eiji Minami, c/o Seiko Epson Corporation, 3-5, Owa 3-chome, Suwa-shi, Nagano-ken 392-8502 (JP)

( * ) Notice: Subject to any disclaimer, the term of this patent is extended or adjusted under 35 U.S.C. 154(b) by 0 days.

(21) Appl. No.: 11/639,920

(22) Filed: Dec. 14, 2006

(65) Prior Publication Data

US 2007/0134960 A1 Jun. 14, 2007

(30) Foreign Application Priority Data

Dec. 14, 2005 (JP) ..... 2005-360565

(51) Int. Cl.
*H01R 3/00* (2006.01)

(52) U.S. Cl. ..... 439/489

(58) Field of Classification Search ..... 439/489, 439/630, 631; 455/556, 566, 414; 710/302, 710/15; 235/441, 492, 380, 188
See application file for complete search history.

(56) References Cited

U.S. PATENT DOCUMENTS 4,507,697 A * 3/1985 Ozil et al. ..... 361/1
4,507,897 A * 4/1985 Vieau et al. ..... 451/548
4,767,918 A * 8/1988 Kushima et al. ..... 235/441
4,785,166 A * 11/1988 Kushima ..... 235/441
4,787,918 A * 11/1988 Ho ..... 44/624
5,463,210 A * 10/1995 Imura ..... 235/441
5,521,586 A * 5/1996 Takeshita ..... 340/635
5,521,588 A * 5/1996 Kuhner et al. ..... 340/825.22
2004/0167997 A1 * 8/2004 Ikeda ..... 710/15
2007/0099481 A1 * 5/2007 Alejandro et al. ..... 439/489

FOREIGN PATENT DOCUMENTS

JP 10-049257 2/1998
JP 2004-503015 1/2004
JP 2004-311416 11/2004

* cited by examiner

*Primary Examiner*—Alexander Gilman
(74) *Attorney, Agent, or Firm*—Nutter McClennen & Fish LLP

(57) ABSTRACT

A power supply method to a memory card that has been inserted into an apparatus that can be inserted with a plurality of types of memory cards, includes: detecting that one type of the memory card out of a plurality of the types of memory cards has been inserted into a card slot; judging whether or not there has been detected an insertion of a different type of memory card from the type of the memory card that has already been detected, within passing of a predetermined time from when the insertion of the one type of the memory card has been detected; specifying the type of the memory card that has been inserted, based on a result of the judgment; and supplying electric power to the specified type of memory card.

8 Claims, 12 Drawing Sheets view from arrow direction view from arrow direction

POWER SUPPLY METHOD TO MEMORY CARD AND PRINTING APPARATUS

CROSS-REFERENCE TO RELATED APPLICATIONS

The present application claims priority upon Japanese Patent Application No. 2005-360565 filed on Dec. 14, 2005, which is herein incorporated by reference.

BACKGROUND

1. Technical Field

The present invention relates to power supply methods to memory cards, and printing apparatuses.

2. Related Art

As apparatuses including a slot for a memory card, for example, there are printing apparatuses that acquire information of an image by directly inserting a memory card stored with information of an image taken by a digital camera and the like into a slot provided in the apparatus, when printing the image taken by the digital camera and the like. At present, a plurality of types of memory cards that have different shapes and positions of a terminal and the like to each other are commercially available. Therefore, the slot provided in the printing apparatus needs to be provided corresponding to a plurality of the types of memory cards. At this time, if the slot is individually provided for each type of card, the space that will be occupied by the slots in the printing apparatus becomes large. Therefore, there is proposed a compound connector for a memory card, that can obtain information from a plurality of the memory cards with one slot. Such a compound connector is provided with a terminal on the connector side, that corresponds to each memory card, and that is in accordance with the positions of the terminals of the respective memory cards so as to contact the terminal of the memory card that has been installed (refer to JP-A-2004-311416, for example).

However, with the aforementioned compound connector, when a certain type of memory card is inserted, the connector-side terminal provided in the position that corresponds to a different type of memory card may contact an exterior portion of the memory card that has been inserted. In such a case, when a conductive member is used for the exterior portion of the memory card, if the type of the inserted memory card is wrongly detected, and power is supplied to the memory card of a type that has been wrongly detected, there is a possibility that a power supply and GND (ground) may develop a short-circuit. Further, even if the surface of the conductive member is coated, the conductive member may be exposed as the coating comes off due to insertion and removal of the memory card. Thus, there is the possibility that the type of memory card is wrongly detected, and a power supply and GND (ground) become short-circuit. In the case where such a compound connector is provided to a printing apparatus, there was a problem of a possibility that the power supply of the printing apparatus is turned off by inserting the memory card.

SUMMARY

It is an object of the present invention to realize a power supply method of a printing apparatus to a memory card, and a printing apparatus, that prevents a voltage being applied to a terminal that does corresponds to a different type of memory card from the type of the memory card that has been inserted.

An aspect of the invention for achieving the above object is a power supply method to a memory card that has been inserted into an apparatus that can be inserted with a plurality of types of memory cards, including:

detecting that one type of the memory card out of a plurality of the types of memory cards has been inserted into a card slot;

judging whether or not there has been detected an insertion of a different type of memory card from the type of the memory card that has already been detected, within passing of a predetermined time from when the insertion of the one type of the memory card has been detected and;

specifying the type of the memory card that has been inserted, based on a result of the judgment; and supplying electric power to the specified type of memory card.

Other features of the present invention will be made clear through the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein.

DESCRIPTION OF EXEMPLARY EMBODIMENTS

Figure 1:
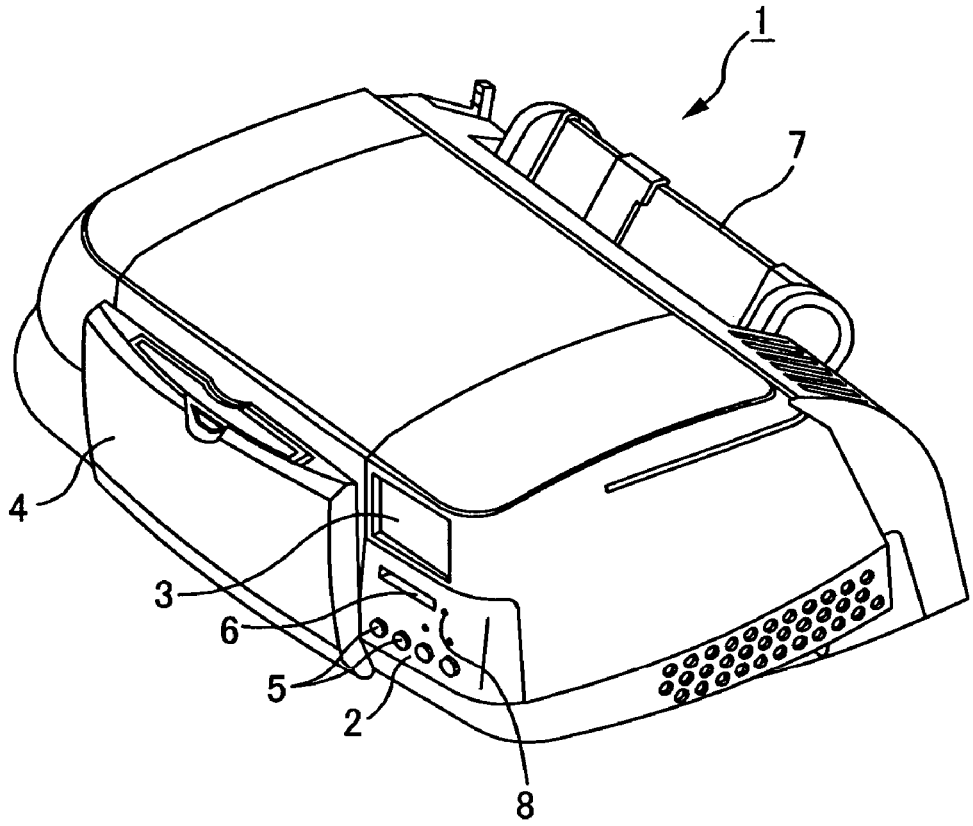
FIG. 1 is a diagram describing an external view of a printer.

At least the following matters will become clear through the description of the present specification and the accompanying drawings.

A power supply method to a memory card that has been inserted into an apparatus that can be inserted with a plurality of types of memory cards, comprising:

detecting that one type of the memory card out of a plurality of the types of memory cards has been inserted into a card slot;

judging whether or not there has been detected an insertion of a different type of memory card from the type of the memory card that has already been detected, within passing of a predetermined time from when the insertion of the one type of the memory card has been detected;

specifying the type of the memory card that has been inserted, based on a result of the judgment; and supplying electric power to the specified type of memory card.

With such power supply method to a memory card, it is possible to supply power corresponding to the type of memory card that has been inserted, even in the case where any type of the memory card which can be inserted into the card slot is inserted. Namely, it is possible to prevent applying a voltage to the terminal corresponding to the memory card other than the type of the memory card that has been inserted.

Further, it is preferable that, in the power supply method to a memory card, the apparatus includes a plurality of pairs of memory detection terminals, corresponding to the types of the memory cards, that are respectively to be connected by a card-side terminal provided to the memory card that has been inserted, the type of the memory card that has been inserted is detected by a plurality of the pairs of the memory detection terminals being selectively connected by the card-side terminal.

With such a power supply method to a memory card, since the type of the inserted memory card is detected by the plurality of pairs of the memory detection terminals that are provided corresponding to the types of the memory cards, being selectively connected by the card-side terminal included in the memory card that has been inserted, it is possible to specify the type of the inserted memory card by a pair of the memory detection terminals corresponding to any type of the memory card being connected.

In such a power supply method to a memory card, it is preferable that one memory detection terminal of the pair of the memory detection terminals is applied with a bias voltage, and the other memory detection terminal is connected to GND.

With such power supply method to a memory card, when the memory card is inserted, the card-side terminal and a pair of the memory detection terminals are connected. At this time, the voltage which has been applied to one of the memory detection terminals drops to GND level, and the memory card is detected as being connected. Therefore, by detecting the voltage of the memory detection terminal to which the bias voltage is being applied to, it is possible to specify the type of the memory card that has been inserted.

In such a power supply method to a memory card, it is preferable that in the case where, within passing of the predetermined time, two or more pairs of the memory detection terminals out of a plurality of the pairs of the memory detection terminals are detected as being connected, the type of the memory card corresponding to the pair of the memory detection terminals that is located at an inner side, in an insertion direction of the memory card, out of the pairs of the memory detection terminals that have been detected as being connected, is specified.

It is fundamentally impossible that two or more pairs of the memory detection terminals, of a plurality of the pairs of the memory detection terminals, are detected as being connected. The memory card corresponding to the pair of the memory detection terminal located at the forward side in the insertion direction of the memory card does not connect a pair of the memory detection terminals located at an inner side than the pair of the memory detection terminals corresponding to the memory card, when it is inserted. On the other hand, there is a possibility that the memory card corresponding to the pair of the memory detection terminals located at the inner side in the insertion direction of the memory card connects a pair of the memory detection terminals located at the forward side than the pair of the memory detection terminals corresponding to the memory card, when it is inserted. Therefore, in the case where two or more pairs of the memory detection terminals located at the inner side and the forward side in the insertion direction of the memory card are detected as being connected, the inserted memory card can be specified as the type of the memory card corresponding to the memory detection terminal located at the inner side. Therefore, by specifying the memory card that has been inserted as the type of the memory card corresponding to the pair of the memory detection terminals located at the most inner side; of the pairs of the memory detection terminals detected as being connected, it is possible to prevent the false detection of the memory card.

In such a power supply method to a memory card, it is preferable that in the case where, within passing of the predetermined time, more than two pairs of the memory detection terminals out of a plurality of the pairs of the memory detection terminals have been detected as being connected, the type of the memory card is not specified.

It is fundamentally impossible that two or more pairs of the memory detection terminals of a plurality of the pairs of the memory detection terminals are detected as being connected. Therefore, it is possible to prevent the false detection of the memory card without fault by not specifying the type of the memory card that has been inserted.

In such a power supply method to a memory card, it is preferable that in the case where the type of the memory card is not specified, electric power is not supplied to the memory card.

With such a power supply method to a memory card, in the case where the type of the memory card that has been inserted is not specified, power is not supplied to the memory card, and therefore, power is not supplied to a wrong terminal, so there is no risk of damaging the memory card by mistake and that the power of an apparatus is shut off.

In such power supply method to a memory card, it is preferable to include, an insertion display section showing that the memory card has been inserted, wherein when connection of one of the pairs of the memory detection terminals has been detected for the first time, an event showing that the memory card has been inserted is displayed on the insertion display section, and in the case where the type of the memory card is not specified, display of the event is cleared.

With such a power supply method to a memory card, when any pair of the memory detection terminals is connected the first time, an event which shows that the memory card has been inserted is displayed, and in the case where the type of the inserted memory card is not specified, the display of the event showing that the memory card has been inserted is cleared. Therefore, the user once confirms display of the event showing that the memory card has been inserted, when any pair of the memory detection terminals is connected the first time, and later visually checks the display that shows the event showing the memory card has been inserted is cleared. Namely, the insertion display section is for showing that the memory card has been inserted, and it is possible to make the user clearly understand that there is an abnormality, when the display showing the event that shows that the memory card has been inserted is cleared, even with the memory card has been inserted.

In such power supply method to a memory card, it is preferable that the apparatus is a printing apparatus for printing an image on a medium.

With such power supply method to a memory card, it is possible to supply power corresponding to the type of the memory card that has been inserted, even in the case where any type of the memory card that can be inserted into the card slot provided to the printing apparatus is inserted.

Also, a power supply method to a memory card that has been inserted into a printing apparatus that can be inserted with a plurality of types of memory cards, including:

detecting that one type of the memory card out of a plurality of the types of memory cards has been inserted into a card slot;

judging whether or not there has been detected, from when the insertion of the memory card has been detected and within passing of a predetermined time, an insertion of a different type of memory card from the type of the memory card that has already been detected;

specifying the type of the memory card that has been inserted, based on a result of the judgment; and supplying electric power to the specified type of memory card, wherein the printing apparatus includes a plurality of pairs of memory detection terminals, corresponding to the types of the memory cards, that are respectively to be connected by a card-side terminal provided to the memory card that has been inserted, wherein the type of the memory card that has been inserted is detected by a plurality of the pairs of the memory detection terminals being selectively connected by the card-side terminal, wherein one memory detection terminal of the pair of the memory detection terminals is applied with a bias voltage, and the other memory detection terminal is connected to GND, wherein in the case where, within passing of the predetermined time, two or more pairs of the memory detection terminals out of a plurality of the pairs of the memory detection terminals are detected as being connected, the type of the memory card corresponding to the pair of the memory detection terminals that is located at an inner side, in an insertion direction of the memory card, out of the pairs of the memory detection terminals that have been detected as being connected, is specified.

With such a power supply method to a memory card, since almost all of the previously described effects can be achieved, the object of the present invention can be achieved more effectively.

Further, it is possible to realize a printing apparatus, including:

a card slot that can be inserted with a plurality of types of memory cards;

a memory detection terminal for detecting that the memory card has been inserted into the card slot, the memory detection terminal corresponding to the type of the memory card;

a power supply terminal for supplying power to the memory card, the power supply terminal corresponding to the type of the memory card;

a controller for judging whether or not there has been detected, from the time that an insertion of the memory card has been detected by an output of the memory detection terminal and within passing of a predetermined time, an insertion of a different type of memory card from the type of the memory card that has already been detected, specifying the type of the memory card that has been inserted based on a result of the judgment, and supplying electric power to the specified type of the memory card; and a printing section that can print on a medium, based on information of the memory card.

Subject of Explanation

Apparatus which is Applied with Power Supply Method to Memory Card

The power supply method to the memory card is applied to an apparatus including a card slot into which a plurality of types of memory cards can be inserted, for example, a printing apparatus having a printing section for printing an image onto a medium such as a paper based on image information. Here, the printing section is a section configured for printing an image onto a medium regardless of whether the memory card is installed or not, and the printing section can print based on an image data, for example, that is stored in the memory card or the like. In this specification, an ink jet printer (hereinafter, simply referred to as a printer) that is one kind of printing apparatus is explained as an example.

Printer

Configuration of Printer 1

Figure 2:
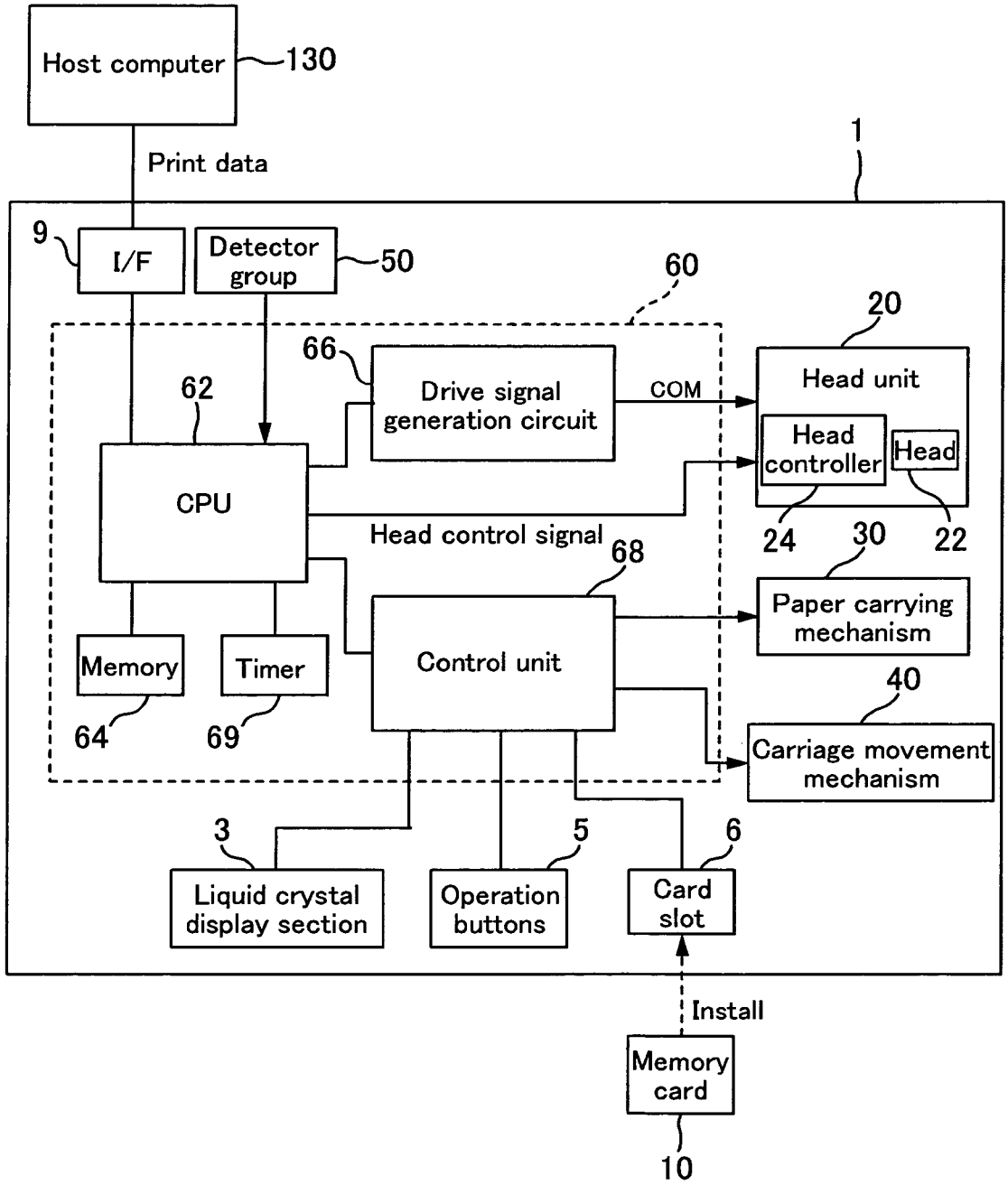
FIG. 2 is a block diagram for describing electrical configuration of the printer.

First, the configuration of a printer 1 is described. Here, FIG. 1 is a diagram describing an external view of the printer 1. FIG. 2 is a block diagram for describing electrical configuration of the printer 1.

As shown in FIG. 1, an operating panel 2, a liquid crystal display section 3, a paper supplying section 7, and a paper-discharge section 4 are provided in a front surface section of the printer 1. Various types of operating buttons 5 and a card slot 6 are provided in the operating panel 2. The operating buttons 5 are operated when carrying out a command to the printer 1. Further, the card slot 6 is a section into which a card-type flash memory, that is, a memory card 10 is to be inserted. Further, next to the card slot 6, there is provided a card access LED 8 for informing the user that the memory card 10 has been installed and the memory card 10 is being accessed.

The memory card 10 is stored with, for example, image information of an image taken by a digital camera and the like. There are a plurality of types of the memory card 10 that have different exterior shapes and positions of the connection terminal and the like. However, the card slot 6 of this printer 1 is configured so that each of a plurality of the types of the memory card 10 can be inserted, and the card slot 6 is configured so that when the memory card 10 is inserted it can connect to slot-side terminals provided according to each memory card 10 inside the card slot 6. Details of the memory card 10, the card slot 6 and the like are described later.

The liquid crystal display section 3 is a section that displays various kinds of information. This liquid crystal display section 3 is a section for displaying a menu, an image to be printed, information to be informed to the user, and the like. In this embodiment, the liquid crystal display section 3 is located above the operating buttons 5. The paper supplying section 7 is provided with a paper supplying tray for holding a cut sheet (not shown) supplied for printing an image. Further, the printer 1 can be provided with a paper supplying mechanism that can print not only on a single-cut sheet printing paper such as a cut sheet, but also on a continuous medium such as a roll paper. The paper-discharge section 4 is provided with a paper-discharge tray that can be opened and closed. The paper-discharge tray is attached so that the upper portion can be reclined forward. The paper-discharge tray functions as a platform on which to place the paper that has been printed, when printing.

Next, the electrical configuration of the printer 1 is described. As shown in FIG. 2, the printer 1 has a head unit 20, a paper carrying mechanism 30, a carriage movement mechanism 40, a detector group 50, a controller 60, the liquid crystal display section 3, the operating buttons 5, and the card slot 6. Further, besides these, the printer 1 has an interface (I/F) 9 to be connected to a host computer 130.

The head unit 20 is for ejecting ink toward a paper as a medium. The head unit 20 is provided with a head 22 for ejecting ink, and a head controller 24 that controls the head 22. The head unit 20 is attached to a carriage (not shown), and when the carriage moves by the carriage movement mechanism 40, the head unit 20 also moves in a carriage movement direction (a direction perpendicular to the carrying direction of paper). The paper carrying mechanism 30 is for supplying a paper as the medium to a printable position, and carrying the paper by a predetermined carry amount in a carrying direction. The paper carrying mechanism 30 is configured with a paper supply roller, a carry roller, and a carry motor and the like (none of them are shown), for example. The carriage movement mechanism 40 is for making the carriage attached with the head unit 20 move in the carriage movement direction. The carriage movement mechanism 40 is configured with a carriage motor, a timing belt, a pulley and the like (none of them are shown), for example. The detector group 50 is for detecting the state of the printer 1. For example, the detector group 50 includes a linear encoder for detecting the position of the carriage, a rotary encoder for detecting the rotation amount of the carry roller and the like, and a paper detector for detecting whether or not a paper is present (none of them are shown).

The controller 60 controls the printer 1. The controller 60 has a CPU 62, a memory 64, a driving signal generation circuit 66, a control unit 68, and a timer 69. The CPU 62 is a computer processing device for carrying out overall control of the printer 1. The memory 64 is for reserving a region for storing programs and a working region or the like for the CPU 62, and is configured by storage elements such as a RAM, an EEPROM, or a ROM. The driving signal generation circuit 66 generates a driving signal that is commonly used. The driving signal generated by the driving signal generation circuit 66 is applied to piezo elements (not shown) included in the head 22. The head controller 24 controls application of the driving signal to the piezo element, based on a head control signal sent from the CPU 62. The control unit 68 is located between the CPU 62 and each of the sections to be controlled, and generates the driving signal for a motor based on a command from the CPU 62, and outputs the signal sent from each section in a form which the CPU 62 can understand. The timer 69 can measure time based on a clock which becomes a reference of processing speed.

Movement of Printer 1

Next, the movement of the printer 1 is described. The process for making the printer 1 operate is performed by the CPU 62, based on a program stored in the memory 64. Therefore, the computer program that makes the CPU 62 operate has a code for realizing these processes.

The printer 1 performs the printing movement when it receives a print command signal from the host computer 130, or when a memory card 10 stored with image information including image data is installed in the card slot 6 and the operating buttons 5 are operated to input a print command. The controller 60 performs processes for printing an image based on the received print data, when the print data is received from the host computer 130 with the print command signal. On the other hand, in the case where the memory card 10 is installed in the card slot 6, and the operating buttons 5 are operated to input a print command, the controller 60 obtains the image data stored in the installed memory card 10, converts the obtained image data into print data which can be printed by the printer 1, and performs the process for printing an image based on the input print command. Namely, the image is formed by making the ink ejected from the head 22 based on the print data land on the paper.

Configuration of Memory Card and Card Slot

The card slot 6 in this embodiment can be installed with a plurality of types of memory cards 10, and can read information from the memory card 10 that has been inserted, or write in information to the memory card 10. Here, the memory card 10 that can be installed in this embodiment is described. An example in which, for example, three types of memory cards 10 (11, 12, 13) can be installed is described here.

Outline of Memory Cards

Figure 3:
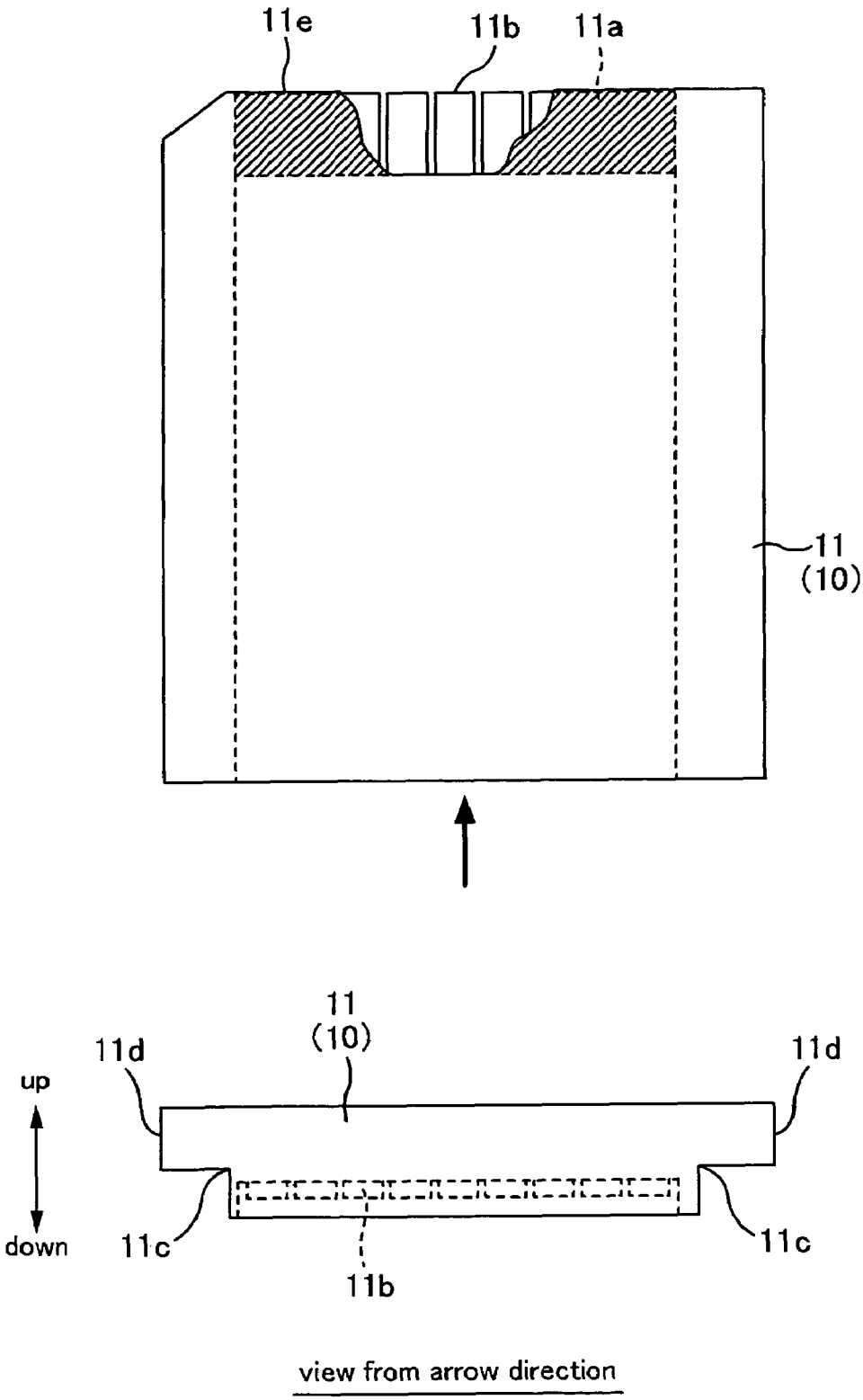
FIG. 3 is a diagram showing a first example of a memory card which can be installed in a card slot in this embodiment.
Figure 4:
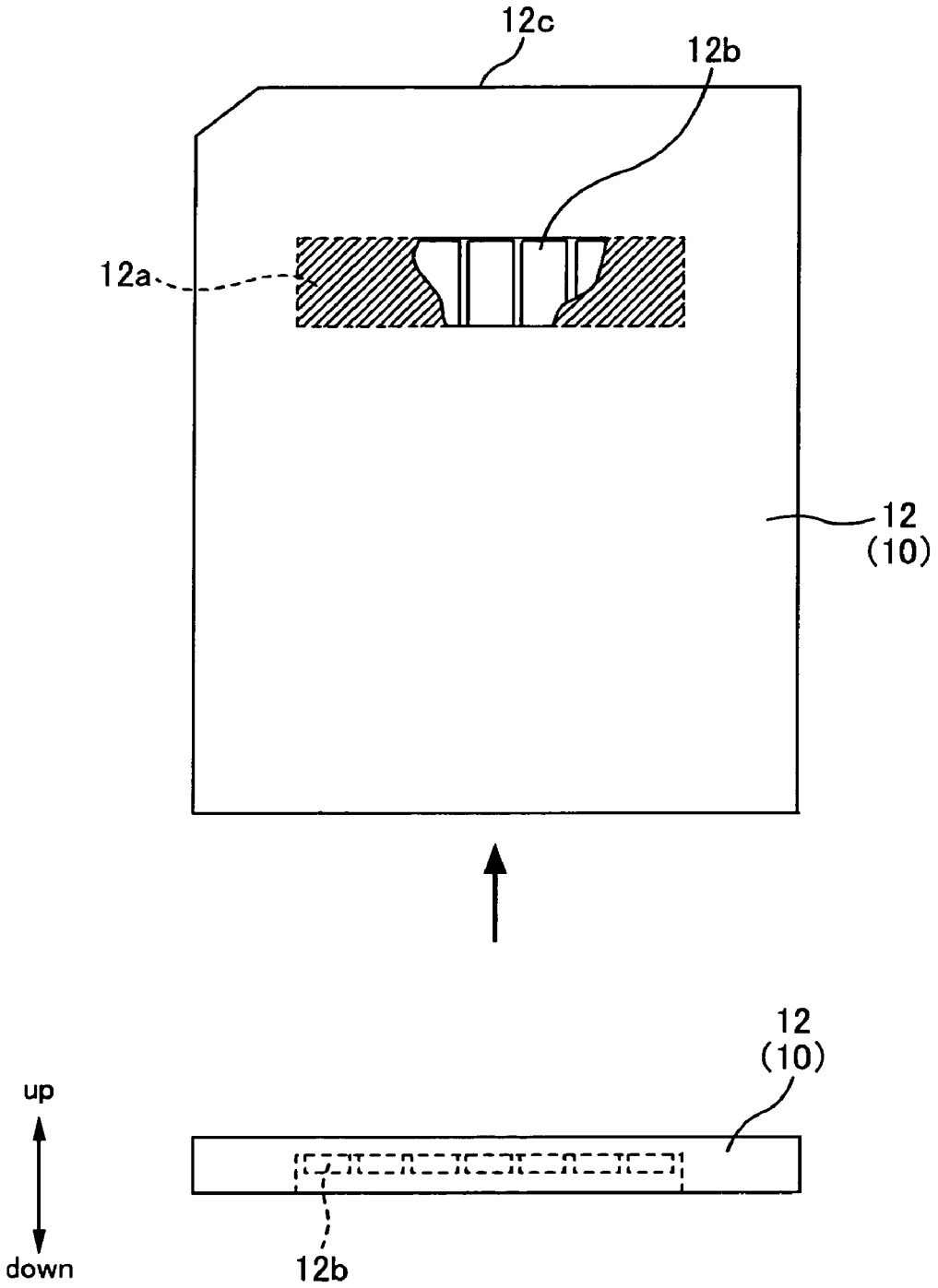
FIG. 4 is a diagram showing a second example of the memory card which can be inserted into the card slot in this embodiment.
Figure 5:
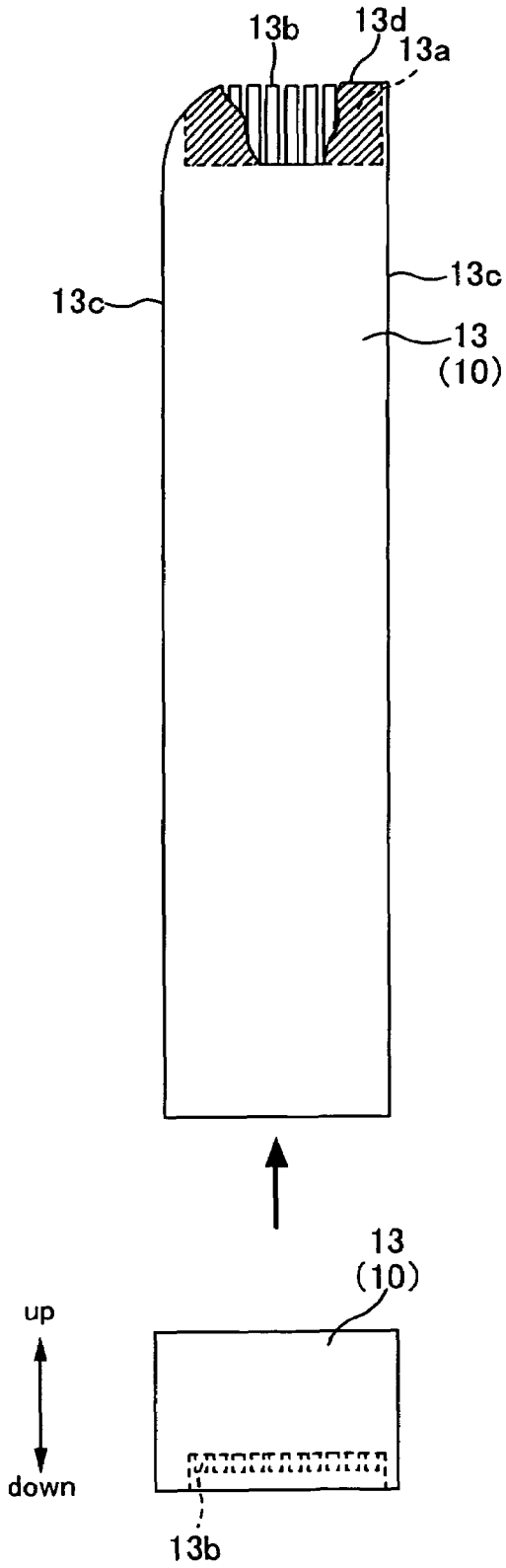
FIG. 5 is a diagram showing a third example of the memory card which can be inserted into the card slot in this embodiment.

FIG. 3 is a diagram showing a first example of a memory card that can be inserted into a card slot in this embodiment. FIG. 4 is a diagram showing a second example of a memory card that can be inserted into a card slot in this embodiment. FIG. 5 is a diagram showing a third example of a memory card that can be inserted into a card slot in this embodiment.

The memory card 11 in the first example (hereinafter, referred to as the first memory card) is a laminated rectangular which is 32.0 mm in length, 24.0 mm in width, and 2.1 mm in thickness, and it is inserted along the direction of the length. At a bottom surface of a tip end section of the memory card that is directed in the insertion direction when inserting are exposed 9 card-side terminals 11*b*. In FIG. 3, an area 11*a* where the card-side terminals 11*b* are provided is shown as a shaded area. The card-side terminals 11*b* are described in detail later. Further, one corner section of the tip end side of the memory card is provided as a slanted inclination, and is configured so that the first memory card 11 is not mistakenly inserted with respect to the front side and the back side or with respect to the insertion direction. On both sides of the first memory card 11 in the width direction, recessed portions 11*c* are respectively provided along the length direction, on a surface side facing downwards when inserting. Namely, the width of the upper portion side and width of the lower portion side of the first memory-card 11 in the inserted state, differ by the amount of the recessed portions 11*c* provided. The thickness of sections 11*d* projecting in the width direction on the upper portion side of the memory card are configured as substantially the same as the thickness of the second memory card 12 described later.

The memory card in the second example (hereinafter, referred to as the second memory card) 12 is a laminated rectangular with the same length and width as the first memory card 11 and a thickness of 1.4 mm, and is inserted along the length direction. The second memory card 12 has 7 card-side terminals 12*b* that are exposed at the bottom surface of the tip end side directed in the insertion direction when inserting. In FIG. 4, an area 12*a* where the card-side terminals 12*b* are provided is shown by a shaded area. Here, the position of the card-side terminals 12*b* when the second memory card 12 is inserted into the card slot 6 is configured to be positioned more toward the forward side in the insertion direction than the position of the card-side terminal 11*b* when the first memory card 11 is inserted into the card slot 6. Details of the card-side terminals 12*b* of the second memory card 12 is described later. Further, a slanted inclination is provided in one of the corner sections on the tip end side of the second memory card 12 to prevent mistakes when inserting.

The memory card 13 in the third example (hereinafter, referred to as a third memory card) is a laminated rectangular which is 50.0 mm in length, 21.5 mm in width, and 2.8 mm in thickness, and has a narrower and a thicker shape than the first memory card 11 and the second memory card 12. The third memory card 13 is inserted along the length direction, and has 10 terminals that are exposed at a bottom surface of the tip end section. In FIG. 5, an area 13*a* where the card-side terminals 13*b* are provided is shown by a shaded area. Details of the card-side terminals 13*b* of the third memory card 13 is described later. Further, one of the tip end corner sections of the third memory card 13 is curved in an arc and has a function to prevent mistakes when inserting.

Configuration of Card Slot

Figure 6:
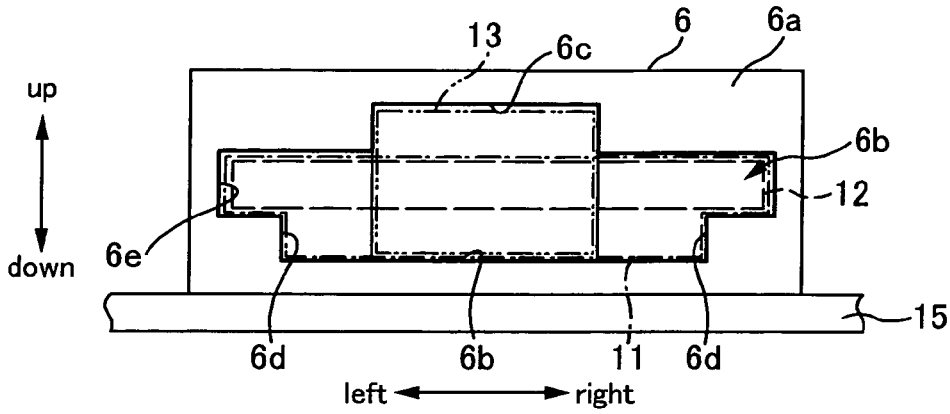
FIG. 6 is a front view of the card slot in this embodiment seen from the side from which the memory card is inserted.
Figure 7:
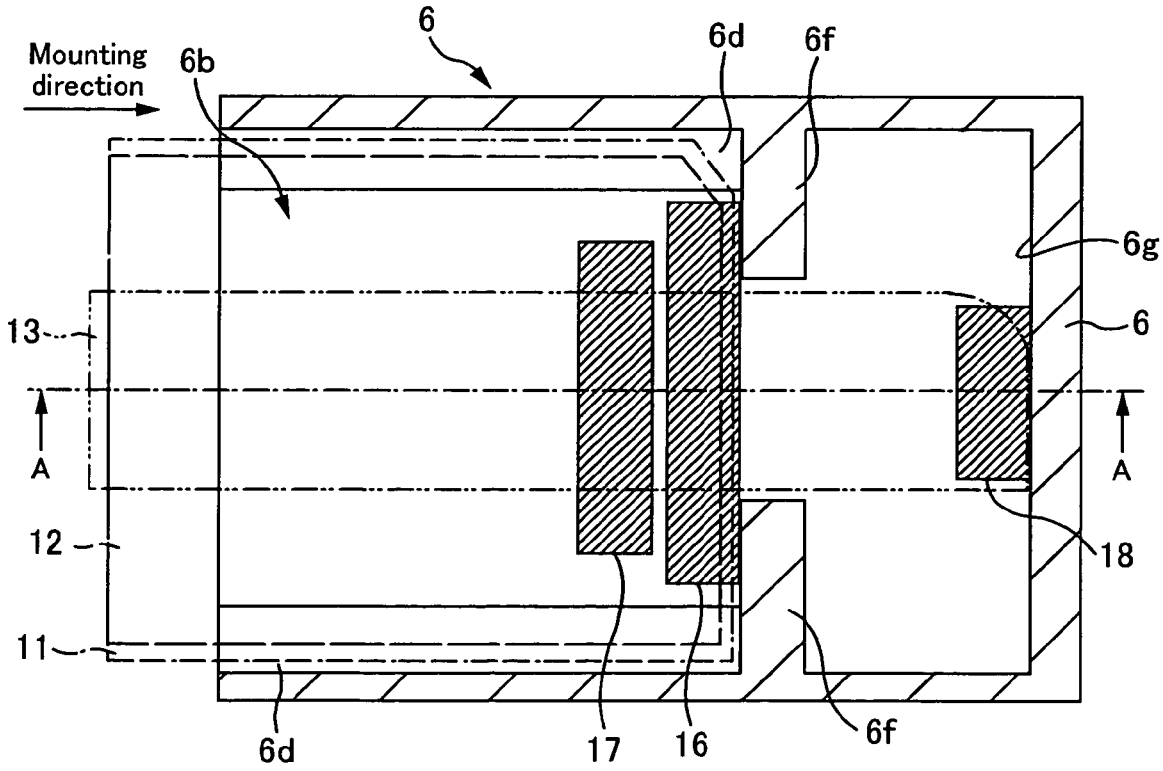
FIG. 7 is a plan sectional view of the card slot in this embodiment.
Figure 8:
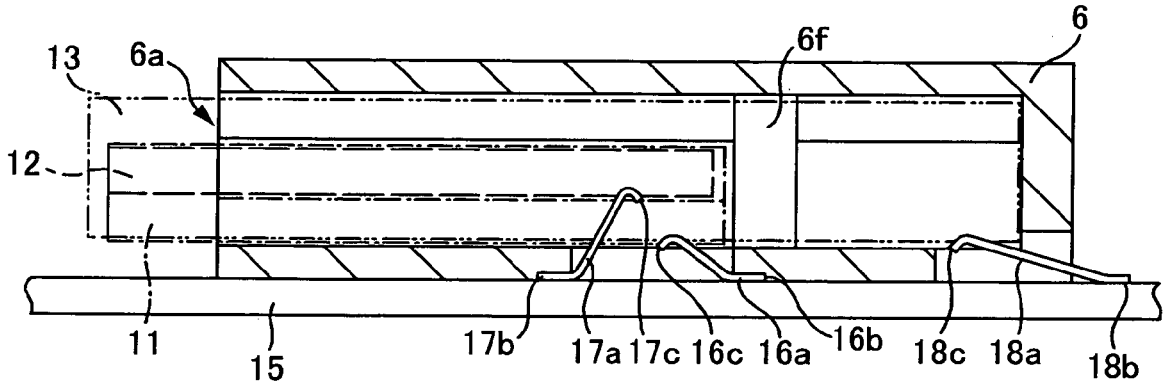
FIG. 8 is a sectional view of FIG. 7 cut at a cross-section A-A.

FIG. 6 is a front view of the card slot in this embodiment seen from the side from which the memory card is to be inserted. FIG. 7 is a sectional plan view of the card slot in this embodiment. FIG. 8 is a sectional view of FIG. 7 cut at a cross-section A-A. For convenience of explanation, in FIG. 6 to FIG. 8 the three types of memory cards are shown by a broken line, an alternate long and short dash line, and an alternate long and two short dashes line, so as not to overlap each line.

Slot-side terminals of the card slot 6 in this embodiment is connected to a wiring pattern of a wiring board 15 as shown in FIG. 8. The card slot 6 has a housing 6*a* that is substantially box-shaped with thin walls. The housing 6*a* is, for example, 37.5 mm in length, 40.7 mm in width, and 6.5 mm in thickness, and the memory card 10 is inserted in the length direction. Namely, an insertion opening 6*b* of the memory card 10 is provided at the side where the memory card 10 is to be inserted in the length direction.

The insertion opening 6*b* is formed so that the above first to third memory cards 11, 12, and 13 can be inserted, and is an opening in a shape wide in the lateral direction and narrow in the vertical direction, and a center section in the lateral direction includes a section 6*c* which is slightly wider than the width of the third memory card 13 and is extended in the upper direction. Further, the lower side of the insertion opening 6*b* lower than substantially halfway is made narrow because of step-like convex portions 6*d* formed on both sides inside the card slot 6 along the insertion direction. A distance between the bottom surface of the insertion opening 6*b* and an upper surface of section 6*c* which is expanded in the upper direction, is formed slightly wider than the thickness of the third memory card 13. Further, widest width sections 6*e* located at the upper side than the step-like convex portions 6*d* are formed slightly wider than the width of the first memory card 11 and the second memory card 12, and a distance between the convex portions 6*d* on both sides is made slightly wider than the distance between the recessed portions 11*c* of the first memory card 11.

As shown in FIG. 7, inside the housing 6*a* that forms the card slot 6, wall sections 6*f* are provided, at a slightly inner side than the center in the depth direction, to which a first memory card 11 and a second memory card 12 that is inserted contact at their tip ends, so as to position the first memory card 11 and the second memory card 12. These wall sections 6*f* are formed on both sides in the left to right direction of the card, with its center section open so as to connect the inner side and the forward side of the wall sections 6*f*.

Further, the slot-side terminals are provided at the bottom surface side inside the card slot 6, so as to contact each of the card-side terminals 11*b*, 12*b*, and 13*b* at positions where each of the memory cards 11, 12, and 13 are installed. The shaded areas in FIG. 7 show areas where the slot-side terminals are provided corresponding to each of the memory cards. Namely, the shaded area located at a further inner side than the wall sections 6*f* is a third terminal area 18 provided with the slot-side terminals 18*a* (FIG. 8) corresponding to the third memory card 13, and the shaded area located forward than the wall sections 6*f* is a first terminal area 16 provided with the slot-side terminals 16*a* (FIG. 8) corresponding to the first memory card 11, and the shaded area located further forward than the first terminal area is the second terminal area 17 provided with the slot-side terminals 17*a* (FIG. 8) corresponding to the second memory card 12.

The slot-side terminals 16*a*, 17*a*, and 18*a* are substantially wire-shaped members with conductivity, such as phosphor bronze, for example, that is formed in a shape so that elastic deformation in the vertical direction is possible. As shown in FIG. 8, the slot-side terminals 16*a*, 17*a*, and 18*a* are respectively connected to the wiring board 15 provided at the bottom side of the housing 6*a*. The slot-side terminals 16*a*, 17*a*, and 18*a* are respectively located along the insertion direction, with one end 16*b*, 17*b*, and 18*b* secured to the housing side and the other end 16*c*, 17*c*, and 18*c* fully bent upwards from bottom surface of the housing 6*a*, and configured to be able to be displaced in the vertical direction by elasticity without being secured. The slot-side terminals 16*a*, 17*a*, and 18*a* that are corresponded to each of the memory card 11, 12, and 13, are provided larger in number by one than the number of the card-side terminals 11*b*, 12*b*, and 13*b* formed on the corresponding memory cards 11, 12, and 13 respectively. Namely, 10 slot-side terminals 16*a* are provided in the first terminal area 16 corresponding to the first memory card 11 that has 9 card-side terminals 11*b*, 8 slot-side terminals 17*a* are provided in the second terminal area 17 corresponding to the second memory card 12 that has 7 card-side terminals 12*b*, and 11 slot-side terminals 18*a* are provided in the third terminal area 18 corresponding to the third memory card 13 that has 10 card-side terminals 13*b*.

When three types of memory cards 11, 12, and 13 are installed appropriately, one pair of memory detection terminals which is set from any two of a plurality of the slot-side terminals 16*a*, 17*a*, and 18*a* in the card slot 6, and one of the card-side terminals 11*b*, 12*b*, and 13*b* of the corresponding memory card 10 come into contact. Further, it is configured so that one of the remaining slot-side terminals 16*a*, 17*a*, and 18*a* excluding the memory detection terminals 19 respectively, and one of the remaining the card-side terminals 11*b*, 12*b*, and 13*b* respectively are to be connected. Namely, one pair of the memory detection terminals 19 (FIG. 9) configured by two slot-side terminals 16*a*, 17*a*, and 18*a*, contacts one card-side terminal 11*b*, 12*b*, and 13*b* of the corresponding memory cards 11, 12, and 13.

When inserting the first memory card 11 into the insertion opening 6*b*, the first memory card 11 is inserted to a position that it reaches the wall sections 6*f* of the card slot 6, with the two recessed portions 11*c* of the first memory card 11 moving along the convex portions 6*d* on the left and right sides of the card slot 6. At this time, the first memory card 11 is entered while pushing down the 8 slot-side terminals 17*a* of the second terminal area 17 to the side of the wiring board 15, and when the tip end 11*e* of the first memory card 11 reaches the wall sections 6*f* of the card slot 6, the 9 card-side terminals 11*b* and the 10 slot-side terminals 16*a* are connected. In this state, the exterior portion of the first memory card 11 is in contact with the slot-side terminals 17*a* that are corresponded to the second memory card 12.

Further, when inserting the second memory card 12 into the insertion opening 6*b*, the second memory card 12 is inserted to a position that it reaches the wall sections 6*f* of the card slot 6, by moving the second memory card 12 along the upper surface of the convex portions 6*d* on the left and right sides of the card slot 6. At this time, when the tip end 12*c* of the second memory card 12 reaches the wall sections 6*f* of the card slot 6, the 7 card-side terminals 12*b* and the 8 slot-side terminals 17*a* are connected. In this state, the exterior portion of the second memory card 12 is in contact with the slot-side terminals 16*a* corresponding to the first memory card 11.

When inserting the third memory card 13 into the insertion opening 6*b*, the third memory card 13 is inserted to a position that reaches the most inner wall 6*g* of the card slot 6, by moving the side surfaces 13*c* of the third memory card 13 along the section 6*c* expanded in the upper direction at the center section in the left to right direction of the card slot 6. At this time, the third memory card 13 enters while pushing down the 8 slot-side terminals 17*a* in the second terminal area 17 and the 10 slot-side terminals 16*a* in the first terminal area 16 to the side of the wiring board 15. When the tip end 13*d* of the third memory card 13 contacts the most inner wall 6*g* of the card slot 6, the 10 card-side terminals 13*b* and the 11 slot-side terminals 18*a* are connected. In this state, the exterior portion of the third memory card 13 is in contact with the slot-side terminals 16*a* that are corresponded to the first memory card 11, and the slot-side terminals 17*a* that are corresponded to the second memory card 12.

Detection Method of Memory Card

Figure 9:
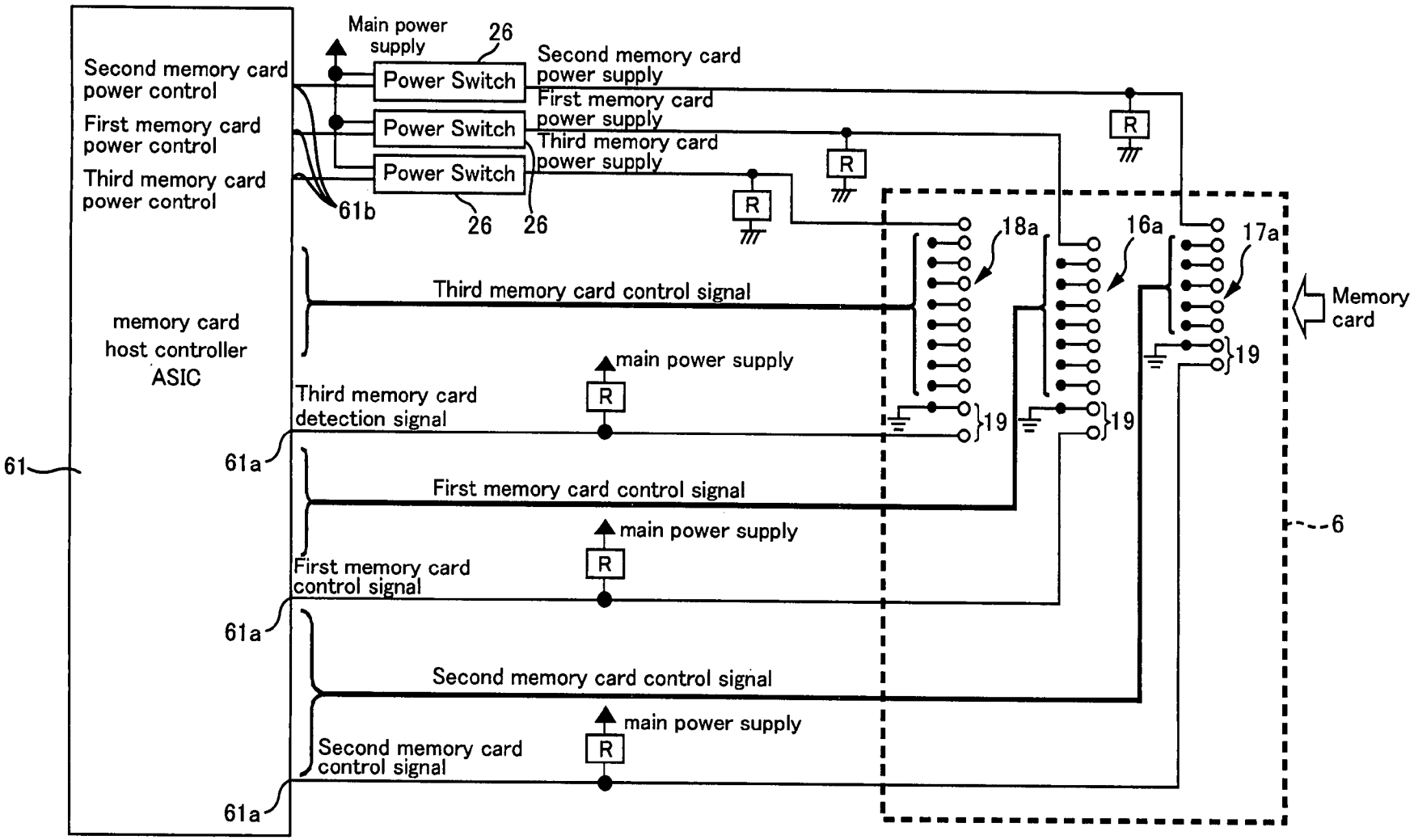
FIG. 9 is a diagram for describing electrical configuration around the card slot in this embodiment.
Figure 10:
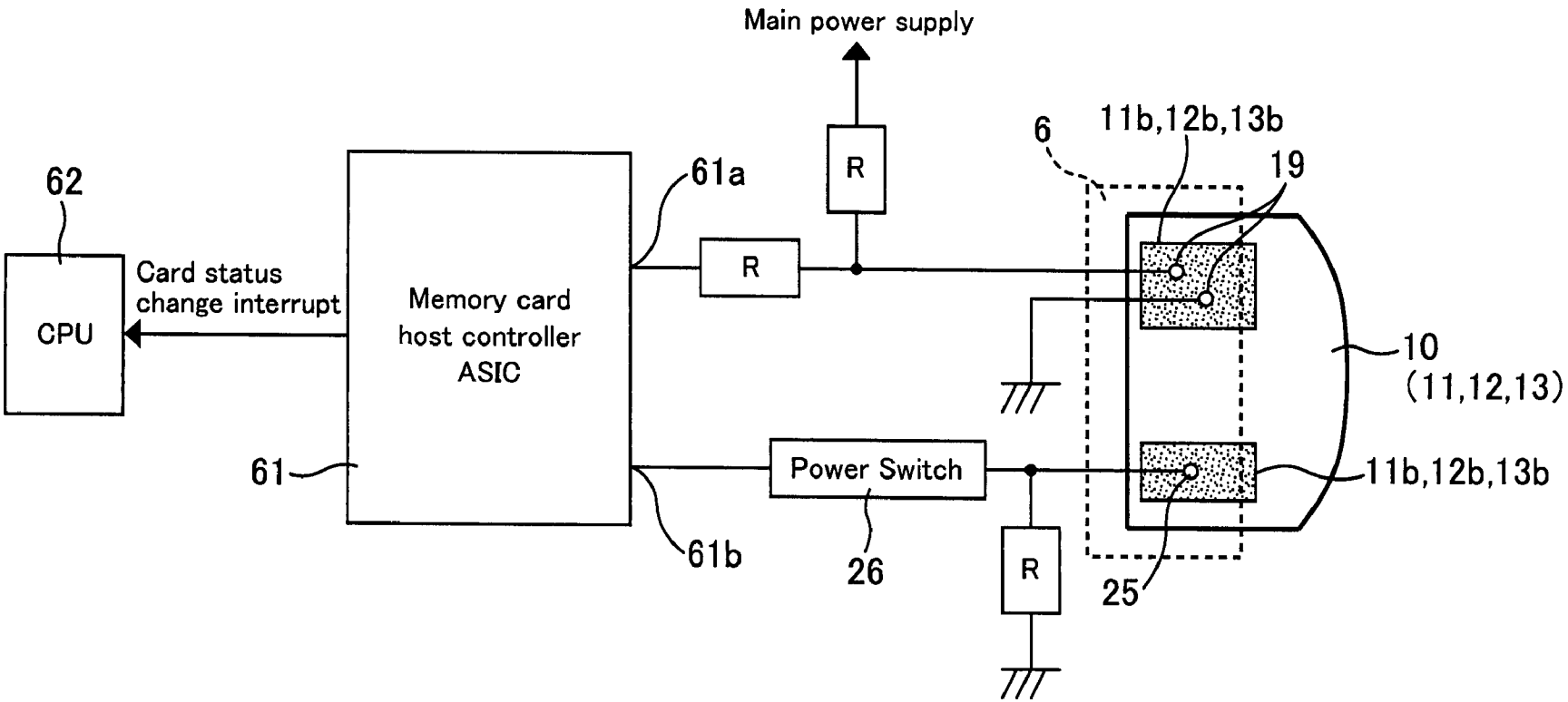
FIG. 10 is a simplified diagram of electrical configuration in FIG. 9.

FIG. 9 is a diagram for describing the electrical configuration in the periphery of the card slot in this embodiment. FIG. 10 is a simplified diagram of the electrical configuration in FIG. 9. As shown in FIG. 9, a plurality of types of the memory card 10 can be installed in the printer 1, however, since the method of supplying power to the memory card 10 is virtually the same in any type of the memory card 10, the example of the first memory card 11 is mainly explained using FIG. 10. Further, in FIG. 10, for convenience in explanation, sections that are provided in each of the various memory cards and that overlap are omitted in the description.

Among the 9 card-side terminals 11*b* provided in the first memory card 11, for example, the card-side terminal 11*b* located in the left end in the insertion direction is connected to a pair of the memory detection terminals 19 in the first terminal area 16 when the first memory card 11 is appropriately installed. One terminal of the pair of memory detection terminals 19 is connected to a card detection terminal 61*a* of ASIC 61 included in the controller 60, and at a same time is also connected to a main power supply (not shown) through a resistance R and is applied with a bias voltage. The other of the pair of the memory detection terminals 19 is connected to the GND (ground). Namely, in the state that the memory card 10 is not installed, the pair of memory detection terminals 19 are not connected to each other, so that when the voltage of the card detection terminal 61*a* is detected, the bias voltage is detected. When the first memory card 11 is installed, the pair of the memory detection terminals 19 are connected by the card-side terminal 11*b* and the voltage of the card detection terminal 61*a* drops to the GND level, and thus it is detected that the memory card 10 has been installed. As shown in FIG. 9, since the pair of the memory detection terminals 19 is provided for each type of the memory card 10, the type of the memory card 10 can be specified, depending on which card detection terminal is the card detection terminal with the voltage that has reduced to the GND level. At this time, since the ASIC 61 and CPU 62 are connected, the signal is output to CPU 62 based on information detected by the ASIC 61.

Configuration of Power Supply Terminal

Further, of the 9 card-side terminals 11*b* provided in the first memory card 11, for example, the card-side terminal 11*b* located in the right end of the first memory card 11 in the insertion direction is set as a power supply terminal 25 to which is supplied electric power for operating the first memory card 11, when the first memory card 11 is appropriately installed. This power supply terminal 25 is connected to the main power supply through a power switch 26 for supplying and shutting off the electric power from the main power supply. Also the power switch 26 is connected to a card power supply control terminal 61*b* of the ASIC 61, from which a signal for controlling the power switch 26 is out putted. The power switch 26 is shut off when the memory card 10 is not installed. Further, the slot-side terminals 17*a*, 18*a* corresponding to the second memory card 12 and the third memory card 13 are respectively set with the 2 slot-side terminals located at the left end in the insertion direction as a pair of the memory detection terminals 19, and the slot-side terminal located at the right end in the insertion direction as the power supply terminal 25.

Power Supply Method to the Memory Card

By the way, three types of the memory card 10 can be installed in the printer 1 in this embodiment. As mentioned above, in the state where the first memory card 11 is installed, the exterior portion of the first memory card 11 contacts the slot-side terminals 17*a* corresponding to the second memory card 12. In the state where the second memory card 12 is installed, the exterior portion of the second memory card 12 contacts the slot-side terminals 16*a* corresponding to the first memory card 11. Further, in the state where the third memory card 13 is installed, the exterior portion of the third memory card 13 contacts the slot-side terminals 16*a* corresponding to the first memory card 11, and the slot-side terminals 17*a* corresponding to the second memory card 12. At this time, there is no problem if the exterior portion of the inserted memory card and the like is formed by an insulating material, but in the case where it is formed by a conductive member, or an adapter and the like for installing a memory card different in size from the memory card 10 which can be installed in the card slot 6 is formed by a conductive member, there is a possibility that the power supply terminal 25 and the pair of the memory detection terminals 19 is connected by the exterior portion of the memory card 10 that has been inserted. In the case where the power supply terminal 25 and the pair of the memory detection terminals 19 are connected, the power supply and the GND make a short circuit, and the power supply of the printer 1 is shut off. Hereinbelow is explained a power supply method to the memory card that prevents power supply of the printer 1 from being shut off, by specifying the type of the memory card that is installed and supplying electric power to the specified type of memory card.

Figure 11:
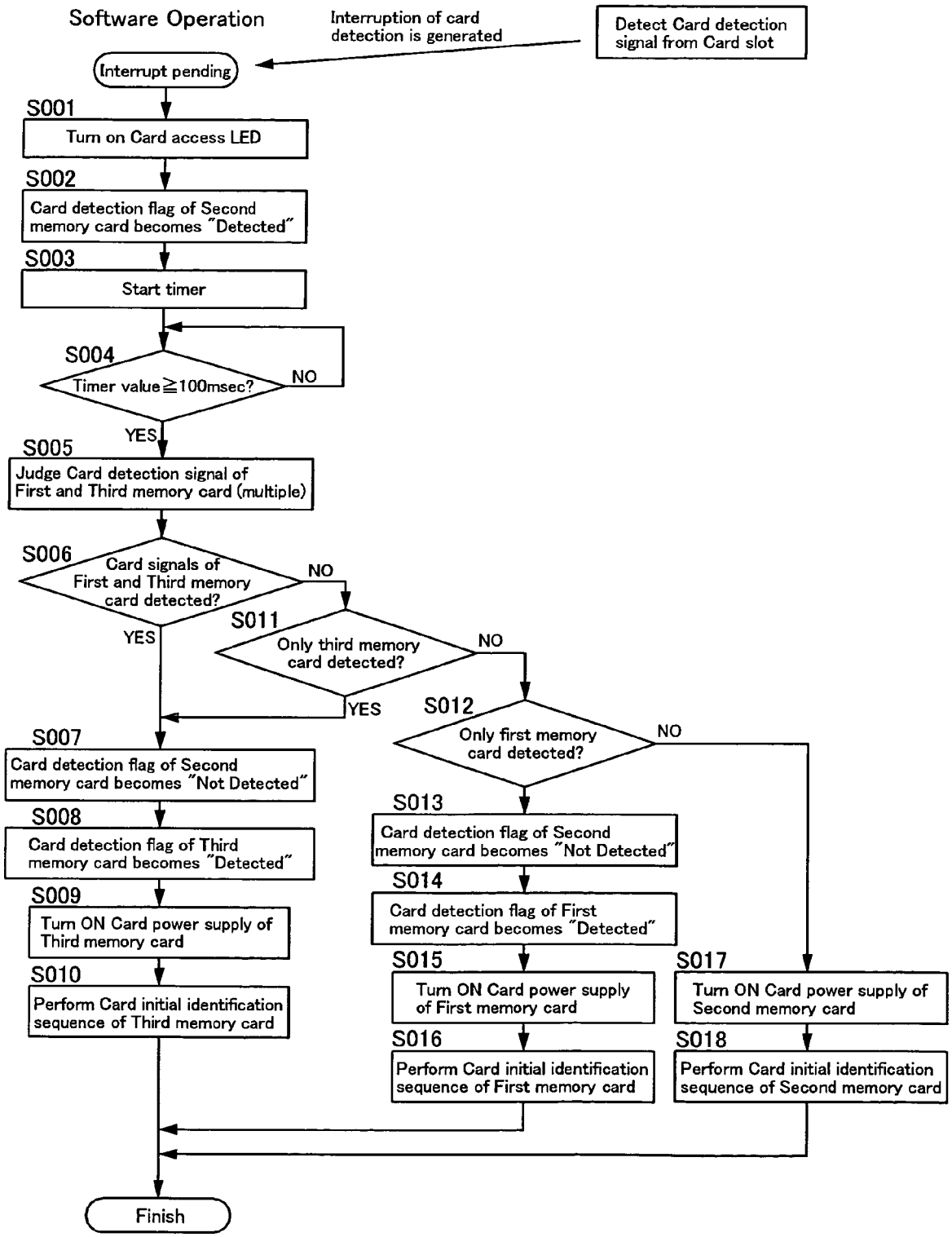
FIG. 11 is a diagram for describing a power supply method to the memory card in the printer in this embodiment.

FIG. 11 is a diagram for describing the power supply method to the memory card in the printer in this embodiment. The process for supplying power to the memory card 10 in the printer 1 is performed by the CPU 62, based on the power supply program to the memory card 10 stored in the memory 64. Therefore, a computer program that operates the CPU 62 includes a code for realizing these processes.

When the power supply of the printer 1 is turned on, due to the process for supplying power to the memory card 10, the printer 1 is kept in the state of interrupt pending. Namely, a bias voltage is applied to one of each of the pairs of the memory detection terminals 19 corresponding to each of the memory cards 10, and the controller 60 detects the voltage of the card detection terminal 61*a* of the ASIC 61, that is connected to the memory detection terminal 19 to which the bias voltage is being applied to. At this time, the card access LED 8 provided at the side of the card slot 6 is turned off. In addition, the power switch 26 provided between the power supply terminal 25 and the power supply is shut off, and the voltage is not applied to the power supply terminal 25.

Then, when any type of the memory card 10 is inserted in the card slot 6, and a pair of the memory detection terminals 19 corresponding to any type of the memory card 10 is connected by the inserted card-side terminal (11*b*, 12*b*, 13*b*) and the like, the controller 60 detects the card detection signal from the card slot 6, and a process for supplying power to the memory card 10 is performed as an interrupt processing. At this time, the card access LED 8 is turned on (S001).

A card detection flag showing that the insertion of the memory card 10 into the card slot 6 has been detected is on in a predetermined area in the memory 64 (S002). In the memory 64, there is set an area in which the card detection flag is on, corresponding to the type of the memory card 10. In the case of this embodiment, since three types of memory cards 10 can be installed, addresses showing three areas inside the memory 64 is corresponded to the types of the memory card 10, and when the memory card 10 is not installed, for example, "0" is stored. When any pair of the memory detection terminals 19 is connected, a value of the address corresponding to the connected pair of the memory detection terminals 19 is rewritten to "1" that shows "detected". Namely, the value of the address corresponding to the pair of the memory detection terminals 19 detected as being connected first is rewritten to "1".

In this embodiment, there is described an example where it is first detected that a pair of the memory detection terminals 19 corresponding to the second memory card, provided most forward in the insertion direction of the memory card, is connected, in an area provided with the slot-side terminals in the card slot 6.

Namely, when any type of the memory card 10 and the like are inserted into the card slot 6, and it is detected that a pair of the memory detection terminals 19 corresponding to the second memory card 12 are connected by the memory card 10 and the like that has been inserted, then the value of the address corresponding to the memory detection terminals 19 of the second memory card 12 is rewritten to "1".

Next the controller 60 starts the timer 69 (S003). The started timer 69 measures the time that has been set in advance (S004) The time that has been set in advance is, for example, set sufficiently longer than the time needed from when the memory card 10 and the like is inserted, into the card slot 6, until the card-side terminals and the slot-side terminals are connected and the memory card 10 has been installed. Here, it is assumed that, for example, 100 msec is set. The controller 60, after 100 msec has passed since the timer 69 has been started, judges whether or not a pair of the memory detection terminals 19 corresponding to a different type of memory card from the type of memory card corresponding to the pair of the memory detection terminals 19 that has already been detected is connected (S005).

Based on the judgment result, the type of the memory card that has been inserted is specified. At this time, in the case where a pair of the memory detection terminals 19 of the slot-side terminals 18*a* corresponding to the third memory card located at a most inner portion, and the slot-side terminals 16*a* corresponding to the first memory card located at an inner side than the slot-side terminals 17*a* corresponding to the second memory card are detected as being connected (S006), a value of the area in the memory 64 corresponding to the second memory card 2, that is written with "1" as being already connected, is rewritten to "0" (S007). Then, the value of the area in the memory 64 corresponding to the third memory card, that has slot-side terminals 18*a* located at a most inner side, is rewritten to "1" (S008). Due to this process, the memory card 10 that has been installed is specified as the third memory card 13.

When the type of the memory card 10 that has been installed is specified as the third memory card 13, the controller 60 applies a voltage to the power supply terminal 25 corresponding to the third memory card 13 (S009). After that, an initial identification sequence in respect to the third memory card 13 is performed (S010).

Further, after 100 msec has passed since the timer 69 has started, when judging whether or not a pair of the memory detection terminals 19 besides the pair of the memory detection terminals 19 that has already been detected is connected, in the case where only a pair of the memory detection terminals 19 of the slot-side terminals 18*a* located at the most inner side is detected as connected (S011), the value of the area in memory 64 corresponding to the second memory card 12, already written with "1" as being connected, is rewritten to "0" (S007). Then, the value of the area in the memory 64 corresponding to the third memory card, that has the slot-side terminals 18*a* located at a most inner side, is rewritten to "1" (S008). Due to this process, the memory card 10 that is installed is specified as the third memory card 13.

When the type of the memory card 10 that is installed is specified as the third memory card 13, the controller 60 applies a voltage to the power supply terminal 25 corresponding to the third memory card 13 (S009). After that, an initial identification sequence in respect to the third memory card 13 is performed (S010).

Further, after 100 msec has passed since the timer 69 has started, when judging whether or not a pair of the memory detection terminals 19 besides the pair of the memory detection terminals 19 already detected is connected, in the case where only the slot-side terminals 16*a* corresponding to the first memory card, located at an inner side than the slot-side terminals 17*a* corresponding to the second memory card, are detected as connected (S012), the value of the area in the memory 64 corresponding to the second memory card 12, already written with "1" as being connected, is rewritten to "0" (S013). Then, the value of the area in the memory 64 corresponding to the first memory card 11, that has the slot-side terminals 18*a* located at the center, is rewritten to "1" (S014). Due to this process, the memory card 10 that is installed is specified as the first memory card 11.

When the type of the memory card 10 that has been installed is specified as the first memory card 11, a voltage is applied to the power supply terminal 25 in the first terminal area 16 corresponding to the first memory card 11 (S015). After that, an initial identification sequence in respect to the first memory card 11 is performed (S016).

Further, after 100 msec has passed since the timer 69 has started, when judging whether or not a pair of the memory detection terminals 19 besides the pair of the memory detection terminals 19 that has already been detected is connected, in the case where pairs of the memory detection terminals 19 of the slot-side terminals 16*a* corresponding to the first memory card 11, located at an inner side than the slot-side terminals 17*a* corresponding to the second memory card 12, and the slot-side terminals 18*a* corresponding to the third memory card 13, located at a most inner side are detected as being not connected (in the case where S006, S011, S012 are all "NO"), the memory card 10 that is installed is specified as the second memory card 12.

When the type of the memory card 10 that has been installed is specified as the second memory card 12, the controller 60 applies a voltage to the power supply terminal 25 corresponding to the second memory card 12 (S017). After that, an initial identification sequence in respect to the second memory card 12 is performed (S018).

For example, in the case where the first memory card 11 is inserted into the card slot 6, a pair of the memory detection terminals 19 corresponding to the second memory card 12 and in the second terminal area 17 located at a most forward portion is connected by the card-side terminals 11*b* of the first memory card 11 when inserting the first memory card 11. At this time, the card access LED 8 is turned on, and the value of an address corresponding to the memory detection terminal 19 of the second memory card 12 is rewritten to "1". Then, the timer 69 is started (S003), and 100 msec that is set in advance is measured (S004). When 100 msec has passed since the timer 69 has started, it is judged whether or not a pair of the memory detection terminals 19 corresponding to a different type of memory card from the type of the memory card corresponding to the pair of the memory detection terminals 19 that has already been detected (S005). At this time, if the inserted first memory card 11 is appropriately installed, it is detected that there are connected only the slot-side terminals 16*a* corresponding to the first memory card, that are located in the first terminal area 16 at an inner side than the slot-side terminals 17*a* corresponding to the second memory card (S012). Then, the value of the area in the memory 64 corresponding to the second memory card, that is written with "1" as being already connected, is rewritten to "0" (S013). After that, the value of the area in the memory 64 corresponding to the first memory card 11, that has the slot-side terminals 16*a* located in the center, is rewritten to "1" (S014). Due to this process, the memory card 10 that is installed is specified as the first memory card 11.

When the type of the memory card 10 that has been installed is specified as the first memory card 11, a voltage is applied to the power supply terminal 25 of the first terminal area 16 that is corresponded to the first memory card 11 (S015). After that, an initial identification sequence in respect to the first memory card 11 is performed (S016).

According to the power supply method to the memory card in this embodiment, in the case where any type of the memory card 10 that can be inserted into the card slot 6 is inserted, it is possible to supply electric power to the memory card 10 that has been inserted, according to the type of the memory card 10 that has been inserted.

Further, with the printer 1 in this embodiment, the type of the memory card 10 that has been inserted is detected by a plurality of pairs of the memory detection terminals 19, that are provided corresponding to the type of the memory card 10, being selectively connected by the card-side terminals of the inserted memory card. Therefore, the type of the memory card that has been inserted can be specified by a pair of the memory detection terminals 19 corresponding to a certain type of the memory card being connected.

Since a pair of the memory detection terminals 19 corresponded to the types of the memory card 10 is configured so that a bias voltage is applied to one of the memory detection terminal 19 and the other memory detection terminal is connected to the GND, when one type of the memory cards 11, 12, and 13 is appropriately inserted, a pair of the memory detection terminals 19 is connected with the card-side terminals 11*b*, 12*b*, and 13*b* corresponding to each memory card. At this time, it is possible to detect which type of the memory cards 11, 12, and 13 is inserted, by the voltage that was applied to one of the memory detection terminals 19 dropping to the GND level. Therefore, the type of the memory card 11, 12, and 13 that has been inserted can be specified, by merely detecting the voltage of the memory detection terminal 19 that is applied with the bias voltage.

Next, a case where the first memory card with the exterior made of a conductive member (hereinafter, referred to as the conductive cover first memory card) is inserted into the card slot 6 is explained.

When the conductive cover first memory card is inserted into the card slot 6, a pair of the memory detection terminals 19 corresponding to the second memory card 12 is connected by the card-side terminals 11*b* of the conductive cover first memory card that has been inserted. At this time, the card access LED 8 is turned on, and the value of the address corresponding to the memory detection terminals 19 of the second memory card 12 is rewritten to "1". Then, the timer 69 is started (S003), and 100 msec that has been set in advance is measured (S004). After 100 msec has passed since the timer 69 started, it is judged whether or not there is connected a pair of memory detection terminals 19 corresponding to a different type of memory card from the type of the memory card corresponding to a pair of the memory detection terminals 19 already detected (S005). At this time, since the conductive cover first memory card that has been inserted is appropriately installed, it is detected that there are connected the slot-side terminals 16*a* corresponding to the first memory card, that are located at an inner side than the slot-side terminals 17*a* corresponding to the second memory card (S012). Also, a pair of the memory detection terminals 19 corresponding to the second memory card 12 is connected by the exterior portion of the conductive cover first memory card. The controller 60 rewrites the value of the area in the memory 64 corresponding to the second memory card 12 to "0" by detecting that the slot-side terminals 16*a* corresponding to the first memory card 11 are connected (S013). After that, the value of the area in the memory 64 corresponding to the slot-side terminals 16*a* in the first terminal area 16, that is located at an inner side than the second terminal area, which is newly detected, is rewritten to "1" (S014). Due to this process, the memory card 10 that has been installed is specified as the first memory card 11.

When the type of the memory card 10 that has been installed is specified as the first memory card 11, a voltage is applied to the power supply terminal 25 corresponding to the first memory card 11 (S015). After that, an initial identification sequence in respect to the first memory card 11 is performed (S016).

Namely, when connection has been detected the first time, a voltage is not applied to the power supply terminal 25 for supplying electric power to the memory card corresponding to the pair of the memory detection terminals 19 that has been detected, and after the set time has passed since the connection has been detected the first time, it is judged whether or not there is connected a pair of memory detection terminals 19 corresponding to another memory card, and a memory card corresponding to a pair of the memory detection terminals 19 located at the most inner side of the pairs of the memory detection terminals 19 that have been detected as connected is specified as the memory card that is installed. Thus, it is possible to more accurately specify the type of the memory card. Especially, as above, in the case where the exterior portion is formed of a conductive member, when a voltage is applied to the power supply terminal 25 for supplying electric power to the memory card corresponding to the memory detection terminal which has been detected as being connected the first time, the power supply and the GND develop a short circuit, and there is a possibility that the power supply of the printer 1 is turned off. However, according to the power supply method to the memory card in above embodiment, it is possible to prevent the power supply of the printer 1 from being shut off.

Further, in the case where the third memory card that has the exterior portion formed of a conductive member (hereinafter, referred to as the conductive cover third memory card) is inserted into the card slot 6, due to the positioning of the memory detection terminals 19, there is a possibility that a pair of the memory detection terminals 19 corresponding to the first memory card 11 and the second memory card 12 becomes connected. However, by specifying a pair of the memory detection terminals 19 located at the most inner side, of the pairs of the memory detection terminals 19 detected as being connected, as the memory card that is installed, it is possible to prevent false detection of the memory card. In this case, a pair of the memory detection terminals 19 that is located at an inner side than a certain pair of the memory detection terminals 19 is not be connected by the card-side terminal of the memory card corresponding to the above-mentioned certain pair of the memory detection terminals 19. On the other hand, there is a possibility that a pair of the memory detection terminals 19 that is located forward than a certain pair of the memory detection terminals 19 is connected when inserting the card-side terminals of the memory card corresponding to the certain pair of the memory detection terminals 19.

Namely, it is fundamentally impossible that two or more pairs of the memory detection terminals 19, of a plurality of the pairs of the memory detection terminals 19, are detected as being connected. The memory card 12 corresponding to the memory detection terminals 19 (17*a*) that are provided at the forward side in the insertion direction of the memory card 10, when it is being inserted, does not connect the memory detection terminals 19 (16*a*, 18*a*) provided at an inner side than the memory detection terminals 19 (17*a*) corresponding to the memory card 12. On the other hand, there is a possibility that the memory card 13 corresponding to the memory detection terminals 19 (18*a*) provided at an inner side in the insertion direction of the memory card, when it is inserted, connects the memory detection terminals 19 (16*a*, 17*a*) provided at the forward side than the memory detection terminals 19 (18*a*) corresponding to the memory card 13. Therefore, in the case where two or more pairs of memory detection terminals 19 detected as being connected are located at the forward side and the inner side in the insertion direction of the memory card, the memory card that has been inserted can be specified as the type of the memory card corresponding to the pair of the memory detection terminals 19 provided at the inner side. Therefore, by specifying the memory card corresponding to the pair of the memory detection terminals 19 located at the most inner side, of the pairs of the memory detection terminals 19 detected as being connected, as the memory card that has been installed, it is possible to prevent the power supply of the printer 1 from being shut off accidentally.

In this embodiment, there is explained an example in which there is first detected as being connected a pair of the memory detection terminals 19 corresponding to the second memory card and provided at the most forward side in the insertion direction, however, the memory card corresponding to the slot-side terminals provided at the most forward side is not always detected first. Therefore, the memory card that is installed can be specified by starting the timer 69 when any of the pair of the memory detection terminals 19 is detected as being connected first, and after the set time has passed, detecting whether or not the rest of the pairs of the memory detection terminals 19 are connected.

Figure 12:
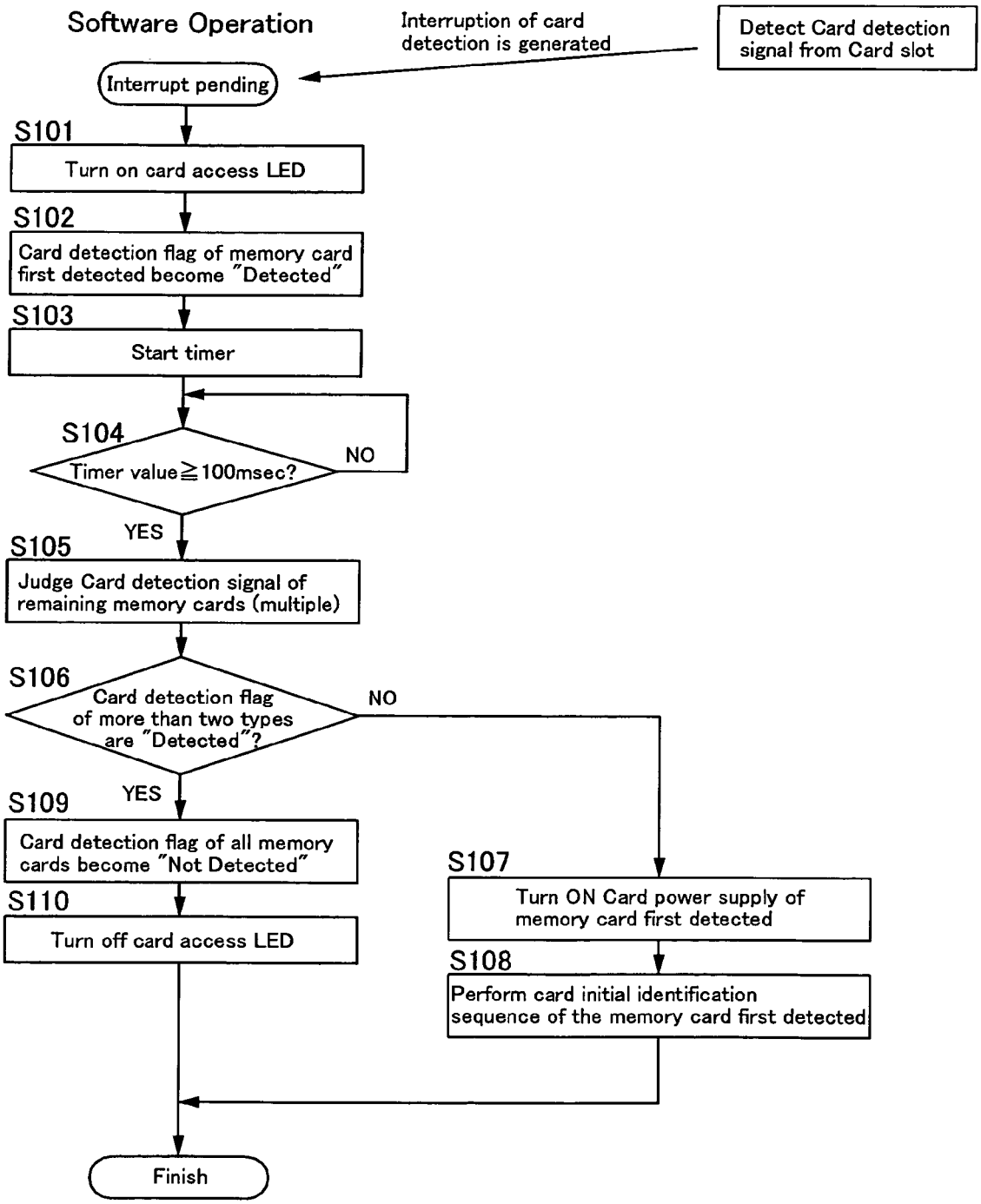
FIG. 12 is a diagram showing the other embodiment in the power supply method to the memory card.

FIG. 12 is a diagram showing other embodiments of the power supply method to the memory card. In this embodiment, the timer 69 is started when it is first detected that any of the memory detection terminals 19 has been connected, after the set time has passed, detecting the memory detection terminals 19 that are connected, and in the case where there are two or more pairs of the memory detection terminals 19 that are detected as being connected, the type of the memory card is not be specified, and electric power is not supplied to any of the memory cards.

In this embodiment, first, when the power supply of the printer 1 is turned on, the printer 1 is kept in the state of interrupt pending, and the card access LED 8 is turned off. When it is detected that any of the memory card 10 and the like has been inserted into the card slot 6, the card access LED 8 is turned on (S101), and the card detection flag showing that the insertion of the memory card 10 into the card slot 6 has been detected is on in a predetermined area of the memory 64 (S102). Next, the controller 60 starts the timer 69 (S103). The started timer 69 measures the time that has been set in advance (for example, 100 msec) (S104). Processes up to here are substantially the same as in the aforementioned embodiment. In this embodiment, the pair of the memory detection terminals 19 detected first is not always the pair of the memory detection terminals 19 located at the most forward side in the insertion direction.

After the time that has been set in advance has passed since the timer 69 has started, it is judged whether or not a pair of the memory detection terminals 19 corresponding to a different type of memory card from the type of the memory card corresponding to the pair of the memory detection terminals 19 already detected is connected (S105). At this time, in the case where, besides the pair of the memory detection terminals 19 already detected, there is not detected a pair of memory detection terminals 19 that is connected (S106), a voltage is applied to the power supply terminal for supplying electric power to the type of memory card 10 corresponding to the memory detection terminals 19 already detected (S107). After that, an initial identification sequence is performed in respect to the memory card 10 supplied with electric power (S108).

On the other hand, after the time that has been set in advance has passed since the timer 69 has started, when judging whether or not a pair of the memory detection terminals 19 other than the pair of the memory detection terminals 19 already detected is connected (S105), in the case where there is a pair of memory detection terminals 19 newly detected as being connected, other than the pair of the memory detection terminals 19 already detected (S109), namely, in the case where more than two pairs of the memory detection terminals 19 are detected as being connected, the value of the area in the memory 64 corresponding to the pair of the memory detection terminals 19 that is newly detected as connected is rewritten to "1" (S107). In such a case, the type of the memory card that is inserted is not specified.

The card access LED 8 that was turned on when it was first detected that the memory card 10 was inserted into the card slot 6 is turned off (S110).

Namely, it is fundamentally impossible that two or more pairs of the memory detection terminals 19 of a plurality of the pairs of the memory detection terminals 19 are detected as being connected. Therefore, in the case where two or more pairs of the memory detection terminals 19 are detected as being connected, by not specifying the type of the memory card 10 inserted, it is possible to prevent wrongly specifying the type of the memory card that has been installed. In the case where the type of the memory card 10 that is inserted is not specified, electric power is not supplied to the memory card 10, and electric power is not supplied to the power supply terminal corresponding to the memory card that has been wrongly specified, and therefore there is no risk of damaging the memory card accidentally, and it is possible to prevent the power supply of the printer 1 from being shut off.

Further, the card access LED 8 as an insertion display section is turned on when any of the pairs of the memory detection terminals is first detected as being connected, and is turned off when two or more pairs of the memory detection terminals 19 are detected as being connected. Therefore, when any of the pairs of the memory detection terminals 19 is connected first, the user is informed that the memory card 10 has been inserted, and in the case where the type of the memory card that has been inserted is not specified, it is possible to inform user that an appropriate memory card has not been inserted by turning off the card access LED 8. Therefore, when any pair of the memory detection terminals 19 is connected first, the user once confirms that the memory card 10 has been inserted, and then visually checks that the card access LED 8 is turned off. Namely, the card access LED 8 shows that the memory card 10 is inserted, and it is possible to make the user effectively recognize an abnormality when the card access LED 8 is turned off, despite the fact that the memory card 10 has been inserted.

Here, the insertion display section for informing the user the event that an appropriate memory card 10 has not being appropriately installed may be not only the card access LED 8, but also the liquid crystal display section 3 that can be used to display a message and the like.

Further, in this embodiment, after the set time has passed since the timer has started, it is judged whether or not the rest of the memory detection terminals 19 are connected, however whether or not the rest of the pairs of the memory detection terminals 19 are connected can be judged sequentially while the timer is activating.

Other Embodiments

In the above embodiment, the power supply method to the memory card and the printer 1 as a printing apparatus are described, however, the foregoing embodiment is for the purpose of elucidating the present invention, and is not to be interpreted as limiting this invention. This invention can of course be altered and improved without departing from the gist thereof, and includes its equivalents. In particular, the following embodiments are also to be included in this invention.

In this embodiment, the card slot 6 to which the three types of the memory card 10 can be installed is described as an example, however, the types of the memory card that can be installed are not limited as such, and any type of card slot is acceptable as long as there are provided, corresponding to each type of the memory card, a memory detection section for each type of memory card, such as the pair of the memory detection terminals 19, and a power supply section to the memory card.

Further, in this embodiment, as the method of detecting that the memory card has been inserted, it is configured so that the insertion of the memory card is detected by a pair of the memory detection terminals 19 provided on the card slot 6 side being connected by the card-side terminals of the memory card 10 that is inserted, however it is not limited as such.

In the above embodiment, an ink-jet printer, as the apparatus to which a plurality of the types of the memory card can be inserted, is described as an example, however, the apparatus to which a plurality of the types of the memory card can be inserted is not limited to the printing apparatus such as an ink-jet printer, and also can be, for example, digital equipment such as a so-called card reader/writer connected to a computer to transfer information of a memory card, or a HDD recorder provided with a card slot.

Figure 13:
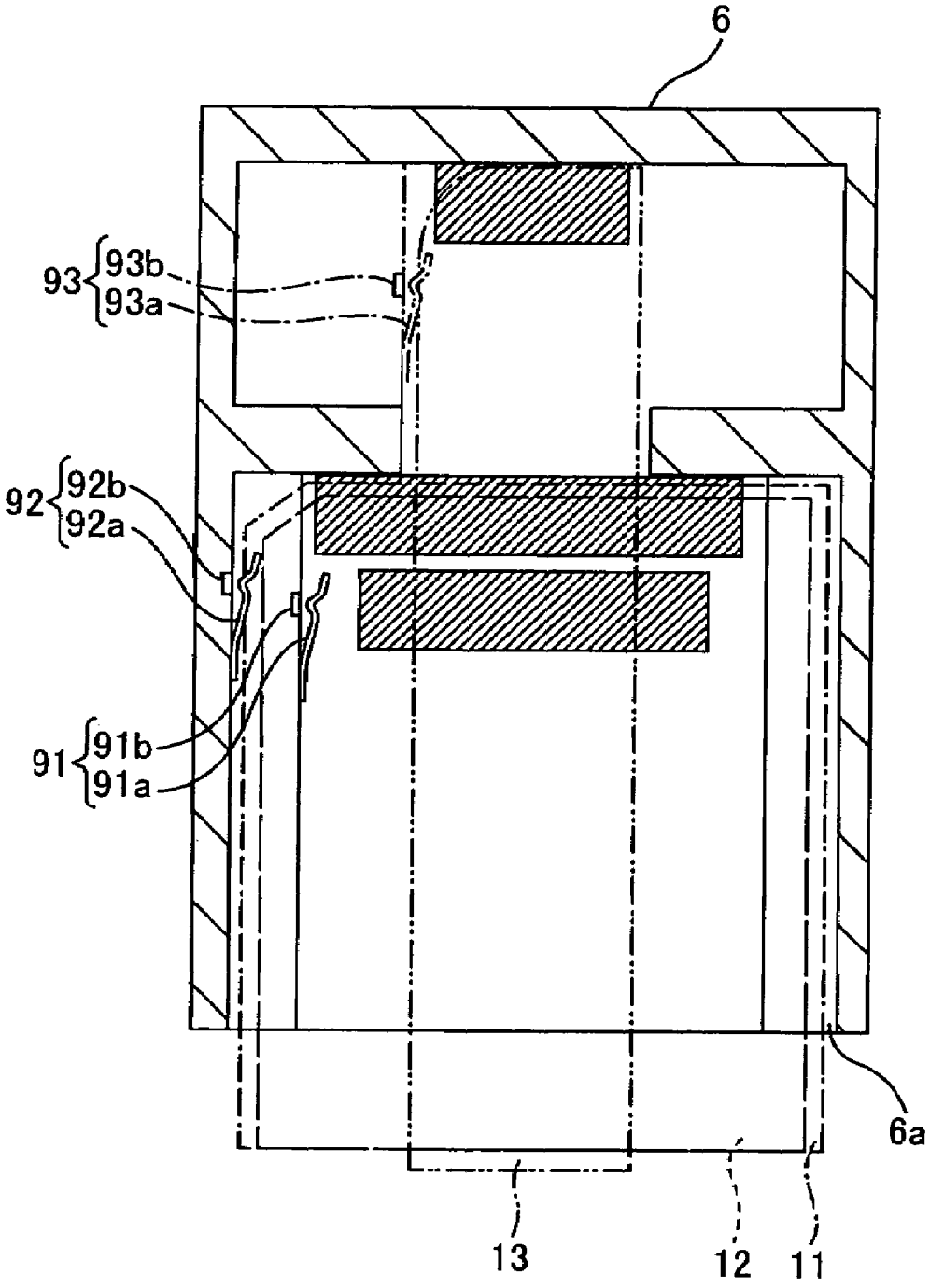
FIG. 13 is a diagram showing another working example of a memory detection terminal.

FIG. 13 is a diagram showing another example of the memory detection terminal. As shown in FIG. 13, for example, it is possible to provide a pair of electrodes 91, 92, and 93 corresponding to the types of the memory cards inside the card slot 6 with an interval between the pair of electrodes, and by inserting the memory card 10, one of the electrodes 91*a*, 92*a*, and 93*a* is pushed by the memory card that is inserted and contacts the other electrodes 91*b*, 92*b*, and 93*b*, so that the insertion of the memory card can be detected. In such a case, when the electrode 91 and the electrode 92 come into contact, the insertion of the first memory card 11 is detected, and when only the electrode 92 is contacted, the insertion of the second memory card 12 is detected, and when the electrode 93 is connected, the insertion of the third memory card 13 is detected. In such a case, the pairs of the electrodes 91, 92, and 93 are the memory detection terminals.

What is claimed is:

1. A power supply method for a memory card that has been inserted into an apparatus that can receive a plurality of types of memory cards, comprising:

detecting that one type of the memory card out of a plurality of the types of memory cards has been inserted into a card slot;

after a predetermined time has passed from detecting that the one type of the memory card has been inserted, judging whether or not there has been detected an insertion of a different type of memory card from the type of the memory card that has already been detected;

specifying the type of the memory card that has been inserted, based on a result of the judgment; and supplying electric power to the specified type of memory card;

wherein the apparatus includes a plurality of pairs of memory detection terminals, corresponding to the types of the memory cards, that are respectively to be connected by a card-side terminal provided to the memory card that has been inserted;

wherein the type of the memory card that has been inserted is detected by a plurality of the pairs of the memory detection terminals being selectively connected by the card-side terminal;

wherein in the case where, after the predetermined time has passed, two or more pairs of the memory detection terminals out of a plurality of the pairs of the memory detection terminals are detected as being connected, the type of the memory card corresponding to the pair of the memory detection terminals that is located at an inner side, in an insertion direction of the memory card, out of the pairs of the memory detection terminals that have been detected as being connected, is specified.

2. A power supply method to a memory card according to claim 1, wherein one memory detection terminal of the pair of the memory detection terminals is applied with a bias voltage, and the other memory detection terminal is connected to GND.

3. A power supply method to a memory card according to claim 1, wherein in the case where, within passing of the predetermined time, more than two pairs of the memory detection terminals out of a plurality of the pairs of the memory detection terminals have been detected as being connected, the type of the memory card is not specified.

4. A power supply method to a memory card according to claim 3, wherein in the case where the type of the memory card is not specified, electric power is not supplied to the memory card.

5. A power supply method to a memory card according to claim 1, comprising, an insertion display section showing that the memory card has been inserted, wherein when connection of one of the pairs of the memory detection terminals has been detected for the first time, an event showing that the memory card has been inserted is displayed on the insertion display section, and in the case where the type of the memory card is not specified, display of the event is cleared.

6. A power supply method to a memory card according to claim 1, wherein the apparatus is a printing apparatus for printing an image on a medium.

7. A power supply method for a memory card that has been inserted into a printing apparatus that can receive a plurality of types of memory cards, comprising:

detecting that one type of the memory card out of a plurality of the types of memory cards has been inserted into a card slot;

judging whether or not there has been detected, from when the insertion of the memory card has been detected and within passing of a predetermined time, an insertion of a different type of memory card from the type of the memory card that has already been detected;

specifying the type of the memory card that has been inserted, based on a result of the judgment; and supplying electric power to the specified type of memory card, wherein the printing apparatus includes a plurality of pairs of memory detection terminals, corresponding to the types of the memory cards, that are respectively to be connected by a card-side terminal provided to the memory card that has been inserted, wherein the type of the memory card that has been inserted is detected by a plurality of the pairs of the memory detection terminals being selectively connected by the card-side terminal, wherein one memory detection terminal of the pair of the memory detection terminals is applied with a bias voltage, and the other memory detection terminal is connected to GND, wherein in the case where, within passing of the predetermined time, two or more pairs of the memory detection terminals out of a plurality of the pairs of the memory detection terminals are detected as being connected, the type of the memory card corresponding to the pair of the memory detection terminals that is located at an inner side, in an insertion direction of the memory card, out of the pairs of the memory detection terminals that have been detected as being connected, is specified.

8. A printing apparatus, comprising:

a card slot into which a plurality of types of memory cards can be inserted;

a memory detection terminal for detecting that the memory card has been inserted into the card slot, the memory detection terminal corresponding to the type of the memory card;

a power supply terminal for supplying power to the memory card, the power supply terminal corresponding to the type of the memory card;

a controller for judging whether or not there has been detected, from the time that an insertion of the memory card has been detected by an output of the memory detection terminal and within passing of a predetermined time, an insertion of a different type of memory card from the type of the memory card that has already been detected, specifying the type of the memory card that has been inserted based on a result of the judgment, and supplying electric power to the specified type of the memory card; and a printing section that can print on a medium, based on information of the memory card.

* * * * *

UNITED STATES PATENT AND TRADEMARK OFFICE

CERTIFICATE OF CORRECTION

PATENT NO. : 7,607,936 B2
APPLICATION NO. : 11/639920
DATED : October 27, 2009
INVENTOR(S) : Mizoguchi et al.

It is certified that error appears in the above-identified patent and that said Letters Patent is hereby corrected as shown below:

On Title Page change "Item (76)" to
--Item (75)--

On Title Page insert
Item --(73) Assignee: SEIKO EPSON CORPORATION (TOKYO, JAPAN)--

Signed and Sealed this

Ninth Day of November, 2010

David J. Kappos

David J. Kappos
*Director of the United States Patent and Trademark Office*